US009636809B2

(12) United States Patent
Lars Elsmark

(10) Patent No.: US 9,636,809 B2
(45) Date of Patent: May 2, 2017

(54) POWER WRENCH

(71) Applicant: ATLAS COPCO INDUSTRIAL TECHNIQUE AB, Stockholm (SE)

(72) Inventor: Karl Johan Lars Elsmark, Saltsjö-Boo (SE)

(73) Assignee: ATLAS COPCO INDUSTRIAL TECHNIQUE AB, Stockholm (SE)

( * ) Notice: Subject to any disclaimer, the term of this patent is extended or adjusted under 35 U.S.C. 154(b) by 421 days.

(21) Appl. No.: 14/390,750

(22) PCT Filed: Apr. 3, 2013

(86) PCT No.: PCT/EP2013/000984
§ 371 (c)(1),
(2) Date: Oct. 3, 2014

(87) PCT Pub. No.: WO2013/149724
PCT Pub. Date: Oct. 10, 2013

(65) Prior Publication Data

US 2015/0090468 A1 Apr. 2, 2015

(30) Foreign Application Priority Data

Apr. 3, 2012 (SE) ..... 1250332

(51) Int. Cl.
*B25B 21/02* (2006.01)

(52) U.S. Cl.
CPC ..... *B25B 21/02* (2013.01)

(58) Field of Classification Search
CPC ..... B25B 21/02; B25B 23/1475
See application file for complete search history.

(56) References Cited

U.S. PATENT DOCUMENTS 5,105,519 A * 4/1992 Doniwa ..... B23P 19/066 173/1
6,680,595 B2 * 1/2004 Ito ..... B25B 23/1405 173/11
2004/0182588 A1 * 9/2004 Tokunaga ..... B25B 21/02 173/2
2013/0008679 A1 * 1/2013 Nishikawa ..... B25B 23/1475 173/93
2013/0014967 A1 * 1/2013 Ito ..... B25F 5/00 173/93

OTHER PUBLICATIONS

International Search Report and Written Opinion dated Aug. 7, 2013 issued in International Application No. PCT/EP2013/000984.

* cited by examiner

*Primary Examiner* — Andrew M Tecco
(74) *Attorney, Agent, or Firm* — Holtz, Holtz & Volek PC

(57) ABSTRACT

An electric power wrench for fastening and loosening joints includes: a main shaft for delivering a torque to a joint, an electric motor that is arranged to selectively drive the main shaft in two opposed rotational directions, a control unit for controlling the drive of the electric motor, and a transmission that connects the electric motor to the main shaft. The control unit has a first drive mode in which it controls the electric motor such that it delivers a continuous torque in a forward direction, and delivers torque pulses in an opposite backward direction, wherein the transmission includes an inherent play and wherein the torque pulses are produced in said play.

15 Claims, 2 Drawing Sheets

POWER WRENCH

The invention relates to an electric power wrench for providing a torque in two opposed rotational directions. Specifically, the invention relates to a power wrench that may be driven as pulsating power wrench by means of an electric motor and a control unit. Further, the invention relates to a method of controlling an electric motor in such a power wrench.

BACKGROUND

A conventional power wrench, such as e.g. a nutrunner, comprises a transmission for providing a torque from a motor to a main shaft.

Normally, the motor is arranged to drive the rotation of the main shaft in two opposed directions, a first forward direction and a second reversed direction. Hence, the transmission needs to be adapted to drive the rotation both in the forward direction and the reversed direction.

In many applications, the reversed drive is only exceptionally used when e.g. a joint is unfastened. This implies that the main focus of the motor and the transmission is on the forward drive.

A problem that needs to be addressed in a hand held power wrench is that the torque provided by the tool needs to be compensated for, such that a counter force is provided for every torque provided by the tool. In a pulsating power wrench most of these counter forces are compensated for by the functional design of the tool itself. This may also be the case in sophisticated continuously driven or non-pulsating tools. In other tools, the counter forces have to be provided by the operator who is holding the tool.

Often, the rotational speed of the motor may be adapted to smoothen or level out the torque provided in the forward direction. This is possible because the torque is relatively low in a first stage, such that inertia is build up to balance out part of the torque as it increases towards the end of the operation. In the reversed direction the conditions are however normally different, because the reversed direction is normally utilised to loosen a joint, which is fastened by a relatively high clamp force, which may only be released by a correspondingly high torque. Hence, often, a high torque needs to be delivered right away, such that it is not possible to build up inertia in the machine.

Therefore, there is a need of a tool that functions well in the forward direction, but that may be adapted or tuned so as to function better than a conventional power wrench in the reversed direction.

SUMMARY OF THE INVENTION

An object of the invention is to provide a power wrench with an improved functionality when driven in the reverse direction.

This object is achieved by the invention according to the independent claims.

According to a first aspect the invention relates to an electric power wrench for fastening and loosening joints, which power wrench comprises:

- a main shaft for delivering a torque to a joint,
- an electric motor that is arranged to selectively drive the main shaft in two opposed rotational directions,
- a control unit for controlling the drive of the electric motor, and
- a transmission that connects the electric motor to the main shaft. The control unit has a first drive mode in which it is adapted to control the electric motor such that it delivers a continuous torque in a forward direction, and such that it delivers torque pulses in an opposite backward direction, wherein the transmission includes an inherent play and wherein the torque pulses are produced within said play.

In a specific embodiment said torque pulses are produced by firstly rotating the motor in the forward direction in order to increase the play and subsequently accelerating the motor in the backward direction so as to produce a torque pulse in the backward direction.

In another embodiment the control unit is arranged to:

- following the step of accelerating the motor in the backward direction, register a parameter relating to the rotation of the output shaft,
- compare said parameter with a threshold value, and
- based on said comparison, decide if a new torque pulse should be produced and all steps should be repeated.

In yet another embodiment said torque pulses are produced intermittently for as long as the motor is driven in the backward direction in said first mode.

In a specific embodiment the power wrench includes a gear that may be selectively positioned in either a first or a second coupling position wherein the first coupling position provides a continuous transmission of the rotation of an input shaft to an output shaft and the second coupling position provides a transmission that includes a limited freedom of motion in which the input shaft may be rotated without affecting the output shaft before engaging the output shaft in at least the backward direction, wherein the control unit is arranged to control the motor such that in the first driving mode the first coupling position is used in a forward direction and the second coupling position is used in a backward direction.

The gear may be a sleeve, which may be translated between the first coupling position and the second coupling position.

An electronic sensor may be provided to register the position of the gear and to signal to the control unit in which of the coupling positions the gear is positioned.

In a specific embodiment the power wrench is provided with a display for monitoring a current position of the gear.

In yet another embodiment the control unit is arranged to control the following steps:

- in response to that the gear is registered to be positioned in the second coupling position, providing said freedom of motion between the input shaft and the output shaft by rotating the motor in a backward direction, and
- accelerating the input shaft in the forward direction in said freedom of motion, such that the rotational movement of the input shaft will be transmitted to the output shaft as an impulse when engagement there between is made.

The power wrench may have a second driving mode in which the motor is driven continuously in both directions, and a third driving mode in which the motor is driven intermittently in both directions.

According to a second aspect the invention relates to a method of controlling an electric motor in a power wrench for fastening and loosening joints, which power wrench comprises:

- a main shaft for delivering a torque to a joint,
- an electric motor that is arranged to selectively drive the main shaft in two opposed rotational directions,
- a control unit for controlling the drive of the electric motor, and
- a transmission that connects the electric motor to the main shaft, the transmission having an inherent play. The method involves a first drive mode in which the electric motor delivers a continuous torque in a forward direction, and torque pulses in an opposite backward direction, wherein the transmission includes an inherent play and wherein the torque pulses are produced within said play.

In a specific embodiment of the method the torque pulses in the backward direction are produced by the following steps:

(a) rotating the motor in the forward direction in order to increase the play, and (b) subsequently accelerating the motor in the backward direction so as to produce a torque pulse.

Another embodiment of the method further comprises the following steps:

(c) registering a parameter relating to the rotation of the main shaft as a consequence of the produced torque impulse, (d) comparing said parameter to a threshold value, and (e) based on said comparison, deciding if all steps (a)-(e) should be repeated.

In a specific embodiment of the method the parameter registered in step (c) is the applied torque, wherein all steps (a)-(e) are repeated if the registered torque exceeds the threshold value.

In another embodiment of the method the operation is concluded if the registered torque underpasses the threshold value.

An advantage of the invention is that the performance of the tool as it operates in the second rotational direction is improved without affecting the performance of the tool when operating in the first rotational direction.

In a specific embodiment the invention relates to a nutrunner.

Other preferred embodiments and advantages of the invention will be apparent from the detailed description and from the dependent claims.

SHORT DESCRIPTION OF THE DRAWING

In the following detailed description reference is made to the accompanying drawings, of which:

DETAILED DESCRIPTION OF THE SHOWN EMBODIMENT

Figure 1:
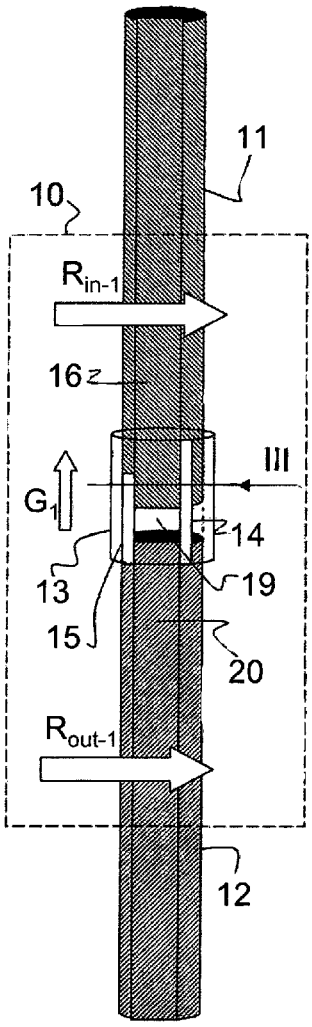
FIG. 1 shows a schematically view of a part of a power wrench according to a specific embodiment of the invention with a gear shown in transparency in a first coupling position.

Below, the invention will be described with reference to the embodiment that is schematically shown in the drawings.

The invention is however not limited by the embodiment shown in the figures. In fact, the embodiment shown in FIGS. 1-5 is only a specific embodiment of a part of the invention.

The main concept of the invention is not shown in a figure. The main concept consists of an electric power wrench for fastening and loosening joints. The power wrench comprises a main shaft for delivering a torque to a joint, an electric motor that is arranged to selectively drive the main shaft in two opposed rotational directions, and a control unit for controlling the drive of the electric motor.

A transmission is arranged to connect the electric motor to the main shaft. The transmission includes an inherent play and wherein the torque pulses are produced in said play. Most transmission in power tools includes an inherent play, which normally amounts to just a fraction of a full rotation of the main shaft. The gist of the invention is to utilize this play in order to produce a torque pulse that will make it possible to e.g. loosening joints without producing massive counter forces that would be difficult to withstand for the operator holding the tool.

This is achieved in that the motor delivers torque pulses in the backward direction, which torque pulses are produced in said play. In a specific embodiment said torque pulses are produced by firstly rotating the motor in the forward direction in order to increase the play and subsequently accelerating the motor in the backward direction so as to produce a torque pulse in the backward direction. These pulses may be produced for as long as the joint is not fully loosened.

Figure 2:
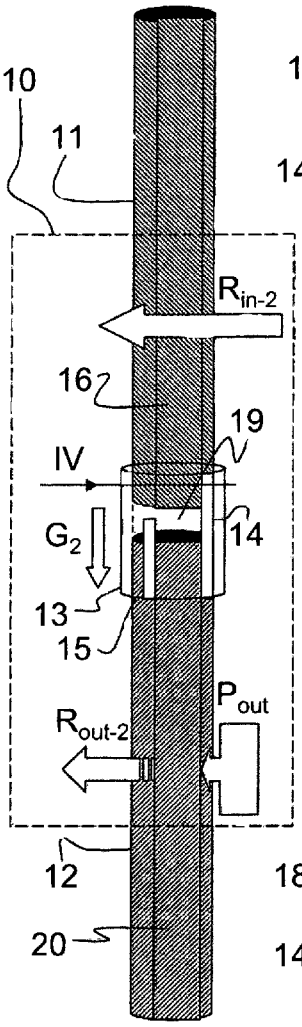
FIG. 2 shows a schematically view of the part shown in FIG. 1 with the gear in a second coupling position.

In FIGS. 1 and 2 a gear unit 10 in a power wrench according to a specific embodiment of the invention is schematically shown in two different coupling positions.

The gear unit 10 includes an input shaft 11, an output shaft 12, and a gear 13. The input shaft 11 and the output shaft 12 are separated by a gap 19, which is housed inside the gear 13. In FIGS. 1 and 2 the gear 13 is shown as being transparent, except for two ribs 14 and 15 that are an integral part of the gear 13.

An electric motor (not shown) is arranged to provide a driving force for driving the rotation of the input shaft 11. The motor is arranged to drive the input shaft 11 in two opposed directions $R_{in\text{-}1}$ and $R_{in\text{-}2}$. The gear 13 is arranged to transmit the rotation of the input shaft 11 to the output shaft 12, such that the output shaft 12 will rotate in the corresponding directions $R_{out\text{-}1}$ and $R_{out\text{-}2}$.

The output shaft 12 is connected to a main shaft (not shown) that includes a socket for holding a tool bit. In one embodiment the output shaft 12 constitutes the main shaft. Also, in another embodiment, the input shaft 11 may in fact be the motor output shaft. Possibly though, the gear transmission may include further gear connections. For instance the rotational speed of the motor output shaft is normally geared down to the main shaft such that the main shaft rotates at a lower rotational speed than the motor output shaft.

In FIG. 1 the gear 13 is positioned in a first coupling position $G_1$, which provides a continuous transmission of the rotation of the input shaft 11 ($R_{in\text{-}1}$) to the output shaft 12 ($R_{out\text{-}1}$). In FIG. 2 the gear 13 is positioned in a second coupling position $G_2$, which provides a transmission that includes a freedom of motion in at least one rotational direction of the input shaft 11 with respect to the output shaft 12.

In the specific shown embodiment the gear 13 is a sleeve, which may be translated between the first coupling position $G_1$ and the second coupling position $G_2$.

The gear 13 involves an inner coupling of the splined type that includes longitudinal grooves and wedges that are adapted to engage with corresponding grooves and wedges on both the input shaft 11 and the output shaft 12.

In the embodiment shown in FIGS. 1-5 the input shaft 11 includes at least one longitudinal tongue 16 that extends about 90° in the circumferential direction of the input shaft 11. The output shaft 12 includes at least one corresponding longitudinal tongue 20. In the first coupling position $G_1$ shown in FIGS. 1 and 3, both tongues 16 and 20 are tightly fitted in sectional cavities 17 formed between a first pair of ribs 14 and a second pair of ribs 15. The ribs 14 and 15 are integrated parts of the gear, and are arranged to interact with the tongue 16 of the input shaft 11 and the tongue 20 of the output shaft 12.

In the first coupling position $G_1$ the play, e.g. the freedom of motion between the input shaft 11 and the gear 13 should be as small as possible, such that the connection between the tongue 16 and the ribs 14 and 15 becomes as tight and rigid as possible. In order for the transmission to be perfectly continuous, the freedom of motion should be none or minimal in this coupling position.

The engagement between the pairs of ribs 14 and 15 and the tongue 16 of the input shaft 11 may be identical to the connection between ribs 14 and 15 and the tongue 20 of the output shaft 12. However, in contrast to the connection of the gear 13 to the output shaft 12, which is continuous, the connection of the gear 13 to the input shaft 11 is variable. As the gear 13 is translated into the second coupling position $G_2$ the coupling between the input shaft 11 and the gear 13 is altered. In the second coupling position $G_2$, shown in FIGS. 2 and 4-5, the gear 13 has been translated such that a non continuous coupling has been accomplished between the input shaft 11 and the gear 13.

As shown in FIGS. 1 and 2, the second pair of ribs 15 does not extend over the whole length of the gear 13. Therefore, as a consequence of the translational movement of the gear 13, the two opposed longitudinal tongues 16 are no longer in engagement with the second pair of ribs 15 when the gear 13 is in the second coupling position $G_2$. Instead, the tongues 16 may rotate freely about 90° inside two opposed sectional cavities 18 formed between each side of the first pair of ribs 14. Hence, in this second coupling position $G_2$, the input shaft 11 may rotate freely within a limited extent with respect to the gear 13 and the output shaft 12.

In accordance with the invention, the first coupling position $G_1$ is arranged to be used in a first of the two opposed directions and the second coupling position $G_2$ is arranged to be used only in the second of the two opposed directions.

This provides the possibility of building up inertia in the form of the rotational speed of the input shaft 11 before impact with the output shaft 12, in order to provide a momentarily elevated torque, which does not have to be counteracted by the operator.

Figure 3:
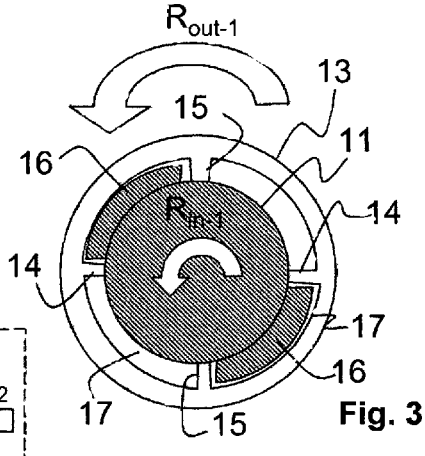
FIG. 3 shows a section along the line III in FIG. 1.

This is schematically illustrated in the figures by means of arrows. In FIGS. 1 and 3 a primary input rotational movement $R_{in\text{-}1}$ of the input shaft is directly transmitted via the gear 13 to the output shaft 12 as a primary output rotational movement $R_{out\text{-}1}$.

Figure 4:
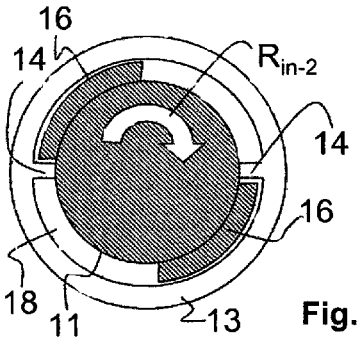
FIG. 4 shows a section along the line IV in FIG. 2.
Figure 5:
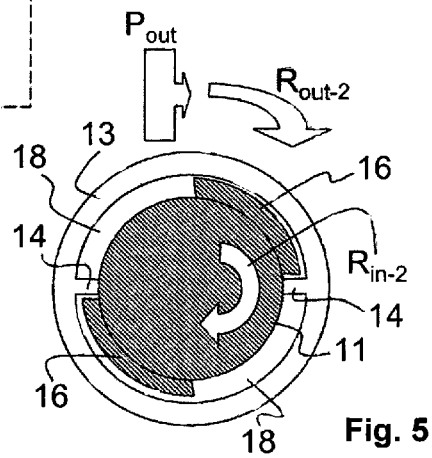
FIG. 5 shows the sectional view in FIG. 4 in a torque transmission phase.

In FIGS. 2 and 4-5, a secondary input rotational movement $R_{in\text{-}2}$ of the input shaft is transmitted via the gear 13 to the output shaft 12 as a pulse $P_{out}$ and a subsequent secondary output rotational movement $R_{out\text{-}2}$. The rotational movement of the pulse $P_{out}$ is build up as the input shaft 11 rotates without affecting the gear 13 and the output shaft 12, whereby the impact between the tongues 16 and the first pair of ribs 14 delivers a pulse with a momentary elevated torque from the input shaft 11 to the output shaft 12 via the gear 13.

In one embodiment of the invention the pulsating movement is repeated for as long as the trigger of the power wrench is actuated, or until the torque needed to continue the reversing operation is below a predetermined threshold value, such as e.g. 8 Nm.

In a typical example a nutrunner is utilised to fasten joints between e.g. bolts and nuts. The fastening is performed in a first direction. When a joint needs to be loosened, an instantaneous high torque is needed in order to release the nut from the bolt. This may be achieved by means of the inventive arrangement.

As mentioned above and as shown in the cross sectional views of the gear 13 in FIGS. 4-5, the second coupling position includes a rotational freedom of motion in the form of sectional cavities 18 in which the tongues 16 of the input shaft 11 may rotate in the reversed direction without affecting the gear 13 and the output shaft 12.

With the inventive gear 13, the second coupling position (FIGS. 2 and 4-5) will provide a momentarily high torque that is build up for up to half a revolution or more of the input shaft 11 before impact transmission to the output shaft 12. The rotational play may of course be adapted to the torque needed for the application.

In order to guarantee the availability of the rotational play inside the sectional cavity 18 in which the tongue 16 may rotate, the gear 13 may be pre-stressed, when in the second coupling position $G_2$. The pre-stress will act to increase the rotational play between the input shaft 11 and the output shaft 12, e.g. to the position shown in FIG. 4. In reality, the input shaft 11 itself may be pre-stressed, e.g. by means of a coil spring. The fact that the input shaft 11 is pre-stressed is advantageous as it guarantees the rotational play even when the power wrench is to be used and when the output shaft is fixed by the interaction between the main shaft and the joint.

Instead of a mechanical gear, the repositioning between the first coupling position $G_1$ and the second coupling position $G_2$ may be achieved in an electrical manner, preferably simultaneously as the rotational direction of the motor is reversed.

In an alternative embodiment the coupling is achieved by a manual operation of a sleeve located on the outside of the tool. In such an embodiment an electronic sensor may be provided to register the position of the gear 13 and to signal in which of the coupling positions it is positioned.

Further, the power wrench may be provided with a display for monitoring a current position of the gear 13.

In a further embodiment of the invention, the power wrench includes a clutch for disconnecting the input shaft 11 completely from the output shaft 12. In one embodiment of the invention this is achieved in that the gear 13 may be positioned in a third position, i.e. a clutch position, in addition to the first and the second coupling position $G_1$ and $G_2$. The clutch position is arranged to involve an unlimited freedom of motion such that the input shaft 11 may be rotated without affecting the output shaft 12 at all when the gear 13 is positioned in the clutch position.

Figure 6:
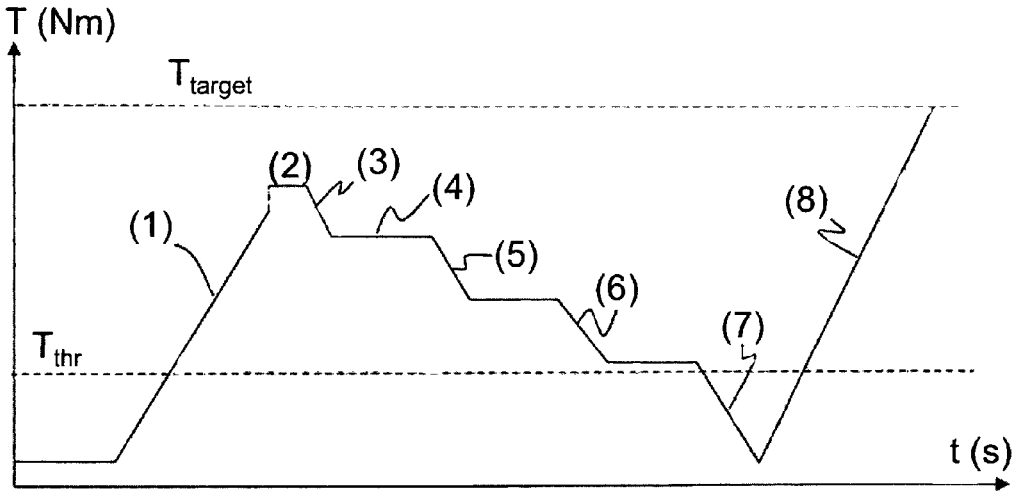
FIG. 6 is a representation of the torque as a function of time in a method according to the invention.
Figure 7:
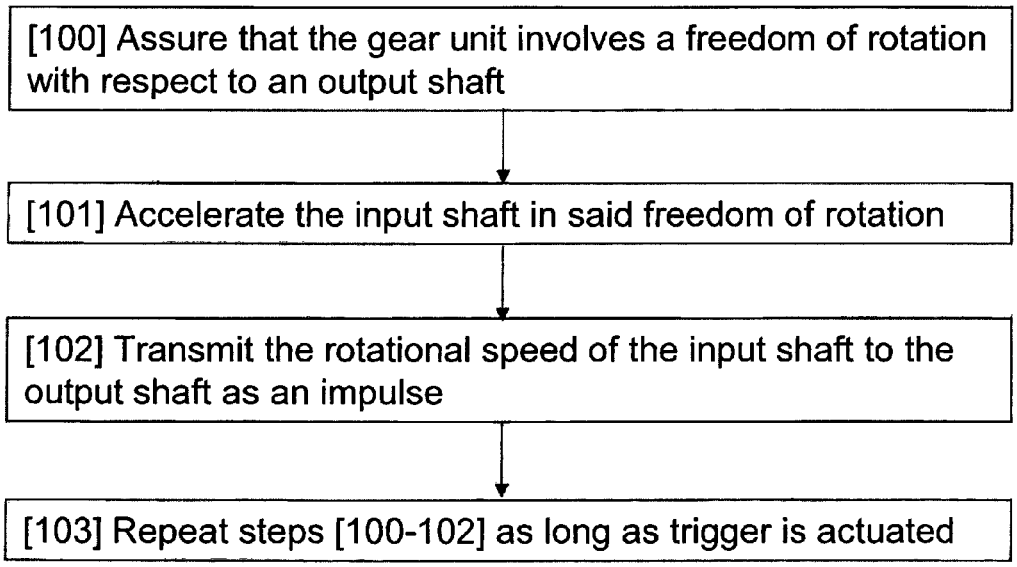
FIG. 7 is a block diagram of a method according to the invention.

FIG. 6 relates to a method of controlling the electric motor in a power wrench according to the invention. In a first step (1), a joint between e.g. a screw and a bolt is tightened in a continuous manner. In most instances when a joint is completed by e.g. a nut-runner a target torque $T_{target}$ is set. The target torque $T_{target}$ be met in target should order to verify the quality of the joint. In the shown embodiment the target torque $T_{target}$ is not met in the first step (1). Normally this is indicated in one way or another to the operator, e.g. on a display of the tool.

In response to said indication, the operator will try to remake the joint. In a continuously operating power wrench it may not be possible to complete the joint by applying a positive torque corresponding to the missing torque. This is due to the fact that the torque needed to complete the joint is so high that the operator will not be able to provide the needed counteraction. Therefore the joint has to be loosened before it may be tightened again.

However, it will be just as difficult to loosen the joint as to tighten it further. According to the invention, the loosening of the joint will however function as an impulse tool, in which inertia is build up inside the tool, which inertia is transmitted to the output shaft in the form of one or several impulses. Hence, in a way, the inventive tool will function as a continuous power wrench in a first (clockwise) direction, and as an impulse tool in a second (counter clockwise) direction.

In a first step the electric motor will be rotated in a forward direction assuring that the play is available in the transmission between the motor and the main shaft. In a specific embodiment a play is available between the input shaft 11 and the output shaft 12. This may be achieved in response to that direction pin on the wrench is set in reverse and that a trigger on the power wrench is pressed.

The second step (2) of the curve in FIG. 6 corresponds to the provision of the freedom of motion between the input shaft 11 and the output shaft 12 as well as the rotation of the motor inside the freedom of motion. Hence, in a first part of the horizontal line corresponding to step (2) the motor may be rotated in a forward direction, and in the second part of step (2) it will be accelerated in a the backward direction until the play has been eliminated, whereupon a torque pulse is generated and step (3) is initiated. In step (3), the main shaft is rotated in a backward direction so as to loosen the joint, typically counter clockwise, such that the torque T in the joint decreases.

Step (3) is followed by a horizontal step (4) which once again corresponds to the provision of the freedom of motion between the motor and the main shaft as well as the rotation of the motor inside said the freedom of motion. Steps (5)-(7) correspond to subsequent impulses, wherein the intermediate steps of repositioning the motor with respect to the main shaft are not indicated with numbers.

In the subsequent step (8) the joint is tightened again, and this time the target torque $T_{target}$ is met in a fully controlled manner.

In FIG. 6, the torque is illustrated so as to vary linearly with respect to time. This is however a simplification of a real operation and is not always the case. FIG. 6 is intended to schematically illustrate an exemplary method in accordance with the invention.

Further, the method may comprise the steps of registering a parameter relating to the rotation of the output shaft 12, as a consequence of the impulse from the input shaft 11 to the output shaft 12, comparing said parameter with a threshold value, and based on said comparison, deciding if steps cited above should be repeated.

In the example illustrated in FIG. 6 the registered parameter is the applied torque, wherein the steps cited above are repeated if the registered torque exceeds the threshold value $T_{thr}$. If the registered torque T underpasses the threshold value $T_{thr}$ the operation may be concluded. In the example shown in FIG. 6, the registered torque T underpasses the threshold value $T_{thr}$ in step (7), which corresponds to the fourth consecutive impulse.

Instead of registering the torque the angular position $\alpha$ of the output shaft 12 or the main shaft may be registered. In such a case, the registered angular position $\alpha$ may be compared to a target angular position $\alpha_{thr}$, such the reversing may be concluded, when the specific target angular position $\alpha_{thr}$ is met. Further, it may be possible to register the clamp force F acting in the joint, e.g. by ultra sounds or by an estimation based on the applied torque. In such a case the actual clamp force F is compared to a threshold value $F_{thr}$, in a corresponding manner.

The step of registering a parameter is however optional. In another embodiment of the invention, the consecutive steps of forwarding and reversing the motor are repeated until the operator releases the trigger. In this respect the function of the reverse mode of the power wrench, which is used when a joint is loosened, corresponds to that of an impulse tool.

Above, the invention has been described with reference to specific embodiments. The invention is however not limited to either of these embodiments. Instead the scope of the invention is defined by the following claims. In other words, the shown exemplary embodiment of the coupling is just one of a number of constructional solutions that may be readily achieved by a person skilled in the art within the scope of the invention.

The invention claimed is:

1. An electric power wrench for fastening and loosening joints, comprising:

a main shaft for delivering a torque to a joint, an electric motor that is arranged to selectively drive the main shaft in two opposed rotational directions, a control unit for controlling the drive of the electric motor, and a transmission that connects the electric motor to the main shaft, wherein the control unit has a first drive mode in which it is adapted to control the electric motor such that it delivers a continuous torque when driven in a forward direction, and such that it delivers torque pulses when driven in an opposite backward direction, wherein the transmission includes an inherent play and wherein the torque pulses are produced within said play.

2. The electric power wrench according to claim 1, wherein said torque pulses in the backward direction are produced by first rotating the motor in the forward direction in order to increase the play and subsequently accelerating the motor in the backward direction so as to produce a torque pulse in the backward direction.

3. The electric power wrench according to claim 2, wherein the control unit is arranged to:

follow the step of accelerating the motor in the backward direction and register a parameter (T, $\alpha$, F) relating to a rotation of an output shaft, compare said parameter (T, $\alpha$, F) with a threshold value ($T_{thr}$, $\alpha_{thr}$, $F_{thr}$), and based on said comparison, decide if a new torque pulse should be produced and all steps should be repeated.

4. The electric power wrench according to claim 2, wherein said torque pulses are produced intermittently for as long as the motor is driven in the backward direction in said first mode.

5. The electric power wrench according to claim 1:

further comprising a gear that may be selectively positioned in either a first or a second coupling position, wherein:

the first coupling position ($G_1$) provides a continuous transmission of a rotation of an input shaft to an output shaft, and the second coupling position ($G_2$) provides a transmission that includes a limited freedom of motion in which the input shaft may be rotated without affecting the output shaft before engaging the output shaft in at least the backward direction, and wherein the control unit is arranged to control the motor such that in the first driving mode the first coupling position ($G_1$) is used in the forward direction and the second coupling position ($G_2$) is used in the backward direction.

6. The electric power wrench according to claim 5, wherein the gear comprises a sleeve, which may be translated between the first coupling position ($G_1$) and the second coupling position ($G_2$).

7. The electric power wrench according to claim 5, wherein an electronic sensor is provided to register the position of the gear and to signal to the control unit in which of the coupling positions (G1; G2) the gear is positioned.

8. The electric power wrench according to claim 7, wherein the power wrench is provided with a display for monitoring a current position of the gear.

9. The electric power wrench according to claim 7, wherein the control unit is arranged to:

in response to that the gear is registered to be positioned in the second coupling position ($G_2$), provide said freedom of motion between the input shaft and the output shaft by rotating the motor in a backward direction, and accelerate the input shaft in the forward direction in said freedom of motion such that the rotational movement of the input shaft is transmitted to the output shaft as an impulse when engagement there between is made.

10. The electric power wrench according to claim 1, wherein the power wrench has a second driving mode in which the motor is driven continuously in both directions, and a third driving mode in which the motor is driven intermittently in both directions.

11. A method of controlling an electric motor in a power wrench for fastening and loosening joints, wherein:

the power wrench comprises:

a main shaft for delivering a torque to a joint, an electric motor that is arranged to selectively drive the main shaft in two opposed rotational directions, a control unit for controlling the drive of the electric motor, and a transmission, having an inherent play, that connects the electric motor to the main shaft, the electric motor delivers a continuous torque in a forward direction and torque pulses in an opposite backward direction in a first drive mode, and the torque pulses are produced within said transmission play.

12. The method according to claim 11, wherein the torque pulses in the backward direction are produced by:

(a) rotating the motor in the forward direction in order to increase the play, and (b) subsequently accelerating the motor in the backward direction so as to produce a torque pulse.

13. The method according to claim 12, further comprising:

(c) registering a parameter (T, $\alpha$, F) relating to a rotation of the main shaft as a consequence of the produced torque pulse, (d) comparing said parameter (T, $\alpha$, F) to a threshold value ($T_{thr}$, $\alpha_{thr}$, $F_{thr}$), and (e) based on said comparison, deciding if all steps (a)-(e) should be repeated.

14. The method according to claim 13, wherein the parameter registered in step (c) is an applied torque (T), and wherein all steps (a)-(e) are repeated if the registered torque (T) exceeds the threshold value ($T_{thr}$).

15. The method according to claim 14, wherein the operation is concluded if the registered torque (T) underpasses the threshold value ($T_{thr}$).

* * * * *